US008062075B2

(12) United States Patent
Huang

(10) Patent No.: US 8,062,075 B2
(45) Date of Patent: Nov. 22, 2011

(54) POWER CONNECTOR HAVING A SIGNAL DETECTING TERMINAL ON A SEPARATION MEMBER

(75) Inventor: Yu-Hung Huang, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 12/862,966

(22) Filed: Aug. 25, 2010

(65) Prior Publication Data

US 2011/0124218 A1 May 26, 2011

Related U.S. Application Data

(63) Continuation-in-part of application No. 12/713,764, filed on Feb. 26, 2010.

(60) Provisional application No. 61/266,627, filed on Dec. 4, 2009, provisional application No. 61/263,895, filed on Nov. 24, 2009.

(30) Foreign Application Priority Data

May 28, 2010 (TW) ..... 99210219 U

(51) Int. Cl.
*H01R 13/502* (2006.01)

(52) U.S. Cl. ..... 439/701

(58) Field of Classification Search ..... 439/701, 439/13, 752.5, 79, 606.01, 607.05
See application file for complete search history.

(56) References Cited

U.S. PATENT DOCUMENTS

| | | | | |
|---|---|---|---|---|
| 6,494,743 | B1 * | 12/2002 | Lamatsch et al. | 439/607.05 |
| 7,025,632 | B2 * | 4/2006 | Hu et al. | 439/606 |
| 7,473,136 | B2 * | 1/2009 | Hu et al. | 439/607.01 |
| 7,780,486 | B2 * | 8/2010 | Yavari et al. | 439/752.5 |
| 7,819,665 | B1 * | 10/2010 | Nishizawa | 439/13 |
| D627,730 | S * | 11/2010 | Huang et al. | D13/146 |
| D627,731 | S * | 11/2010 | Huang et al. | D13/146 |

* cited by examiner

*Primary Examiner* — Chandrika Prasad
(74) *Attorney, Agent, or Firm* — Kirton & McConkie; Evan R. Witt

(57) ABSTRACT

A power connector includes a main body, a first conductive terminal, a second conductive terminal, a third conductive terminal, and an insulating separation member. The first conductive terminal, the second conductive terminal and the third conductive terminal are disposed within the main body and arranged in a non-parallel manner. The insulating separation member is disposed within the main body, and arranged between the first conductive terminal, the second conductive terminal and the third conductive terminal for separating at least two of the first conductive terminal, the second conductive terminal and the third conductive terminal from each other.

13 Claims, 19 Drawing Sheets

11

32

POWER CONNECTOR HAVING A SIGNAL DETECTING TERMINAL ON A SEPARATION MEMBER

CROSS-REFERENCE TO RELATED APPLICATIONS

This application is a continuation-in-part of U.S. Utility patent application Ser. No. 12/713,764, which is entitled "POWER SUPPLY WITH ARC FLASH PROTECTION MECHANISM AND DATA-PROCESSING SYSTEM EMPLOYING SAME" and filed on Feb. 26, 2010, which claims the benefit of prior U.S. provisional application 61/263,895, which is entitled "INTELLIGENT POWER CONNECTOR ASSEMBLY CAPABLE OF PREVENTING GENERATION OF ARC FLASH" and filed on Nov. 24, 2009, and claims the benefit of prior U.S. provisional application 61/266,627, which is entitled "ARC FLASH PROTECTION MECHANISM FOR POWER SUPPLY AND DATA-PROCESSING SYSTEM EMPLOYING SAME" and filed on Dec. 4, 2009.

This application also claims the benefit of prior U.S. provisional application 61/263,895, which is entitled "INTELLIGENT POWER CONNECTOR ASSEMBLY CAPABLE OF PREVENTING GENERATION OF ARC FLASH" and filed on Nov. 24, 2009, and claims the benefit of prior U.S. provisional application 61/266,627, which is entitled "ARC FLASH PROTECTION MECHANISM FOR POWER SUPPLY AND DATA-PROCESSING SYSTEM EMPLOYING SAME" and filed on Dec. 4, 2009.

FIELD OF THE INVENTION

The present invention relates to a connector and a connector assembly, and more particularly to a power connector and a power connector assembly.

BACKGROUND OF THE INVENTION

Power connectors are widely used in electric networks, power transmission systems, power distribution systems, power supply systems, electronic devices, and the like. The power connectors are used as interfaces of delivering and receiving electricity. For example, a power supply and a power cord are connected with each other through a power connector assembly. Generally, the power connector assembly includes a power plug and a power socket. Via the assembly of the power plug and the power socket, electric connection and power transmission are achieved.

With increasing development of science and technology, more and more electronic devices are designed in views of power-saving efficacy. Recently, the power distribution and supply system for a large-sized data processing apparatus (e.g. a data center). Since high-voltage DC power distribution and supply system could provide stable power at reduced power loss and reduced cost, the high-voltage DC power distribution and supply system is gradually adopted. In the high-voltage DC power distribution and supply system, the conventional power connector usually fails to comply with the electric safety standard. Once the conventional power connector is used in the high-voltage DC power distribution and supply system, some components are readily damaged. Moreover, in the power distribution and supply system, electric arc is readily generated at the moment when two power connectors are coupled with each other or detached from each other. The generation of the electric arc may result in damage of the system load.

For complying with the electric safety regulation, there is a need of providing a power connector and a power connector assembly for use in a high-voltage DC power distribution and supply system.

SUMMARY OF THE INVENTION

It is an object of the present invention to provide a power connector and a power connector assembly for use in a high-voltage DC power distribution and supply system, in which the power connector and the power connector assembly are produced in a simplified and cost-effective manner.

Another object of the present invention provides a power connector assembly, in which two power connectors are securely coupled with each other without damaging the conductive terminals.

A further object of the present invention provides a power connector and a power connector assembly with detecting functions in order to avoid electric arc generation, increase electric safety and facilitate power distribution and management.

In accordance with an aspect of the present invention, there is provided a power connector. The power connector includes a main body, a first conductive terminal, a second conductive terminal, a third conductive terminal, and an insulating separation member. The first conductive terminal, the second conductive terminal and the third conductive terminal are disposed within the main body and arranged in a non-parallel manner. The insulating separation member is disposed within the main body, and arranged between the first conductive terminal, the second conductive terminal and the third conductive terminal for separating at least two of the first conductive terminal, the second conductive terminal and the third conductive terminal from each other.

In accordance with another aspect of the present invention, there is provided a power connector assembly. The power connector assembly includes a first power connector and a second power connector. The first power connector includes a first main body, a first conductive terminal, a second conductive terminal and a third conductive terminal. The first conductive terminal, the second conductive terminal and the third conductive terminal of the first power connector are disposed within the first main body and arranged in a non-parallel manner. A first insulating separation member is disposed within the first main body for separating at least two of the first conductive terminal, the second conductive terminal and the third conductive terminal of the first power connector from each other. The second power connector is configured to be coupled with the first power connector. The second power connector includes a second main body, a first conductive terminal, a second conductive terminal and a third conductive terminal. The first conductive terminal, the second conductive terminal and the third conductive terminal of the second power connector are disposed within the second main body and arranged in a non-parallel manner. A second insulating separation member is disposed within the second main body for separating at least two of the first conductive terminal, the second conductive terminal and the third conductive terminal of the second power connector from each other. The first insulating separation member and the second insulating separation member have complementary profiles for guiding connection between the first power connector and the second power connector.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
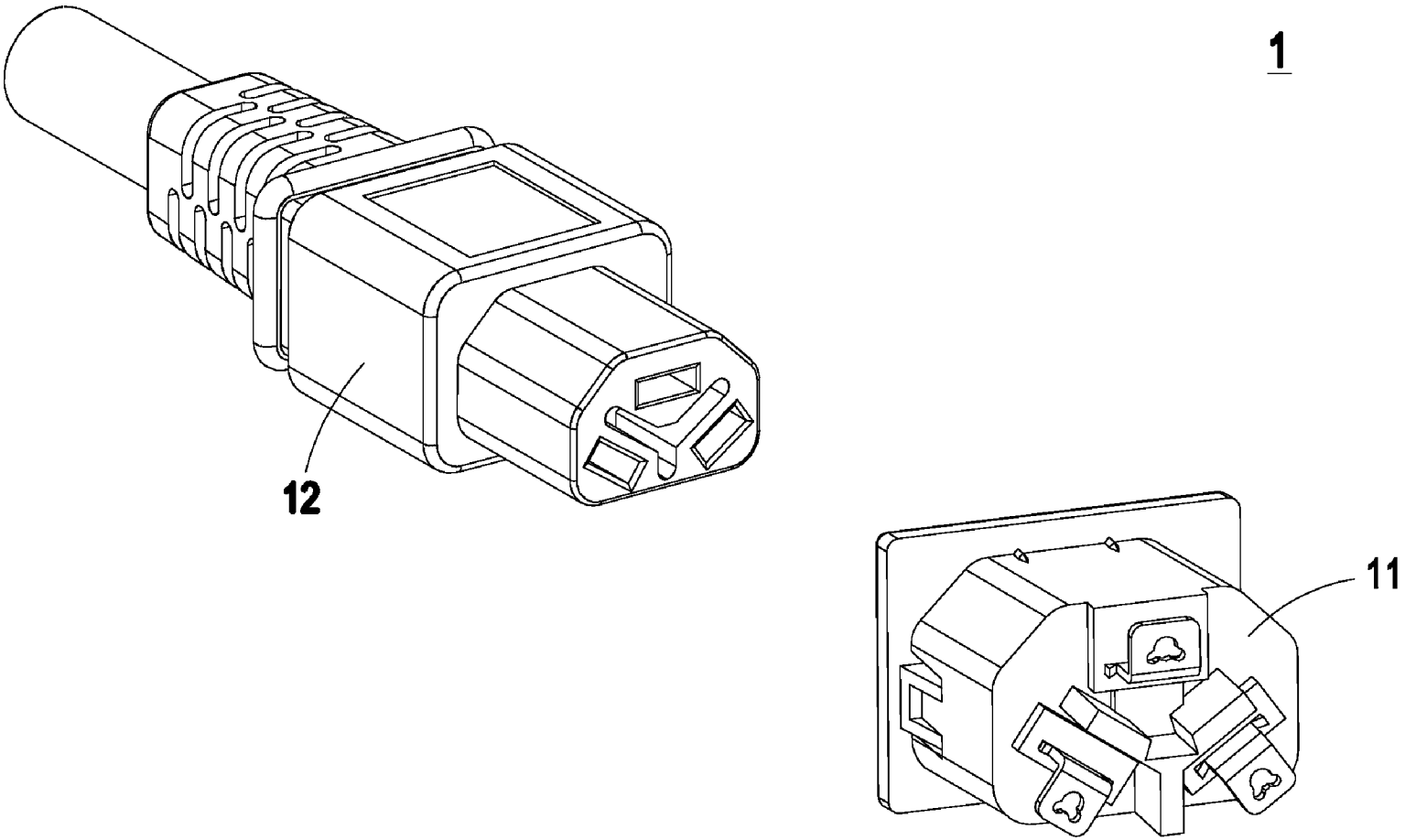
FIG. 1 is a schematic perspective view illustrating a power connector assembly according to a first embodiment of the present invention.

FIG. 1 is a schematic perspective view illustrating a power connector assembly according to a first embodiment of the present invention. As shown in FIG. 1, the power connector assembly 1 comprises a first power connector 11 and a second power connector 12. In this embodiment, the first power connector 11 is a power socket, which is for example installed on a power supply. The second power connector 12 is a power plug, which is for example installed on a tip portion of a power cord. The first power connector 11 and the second power connector 12 have complementary structures. Due to the complementary structures, the first power connector 11 and the second power connector 12 are electrically with each other to produce the power connector assembly 1.

Figure 2A:
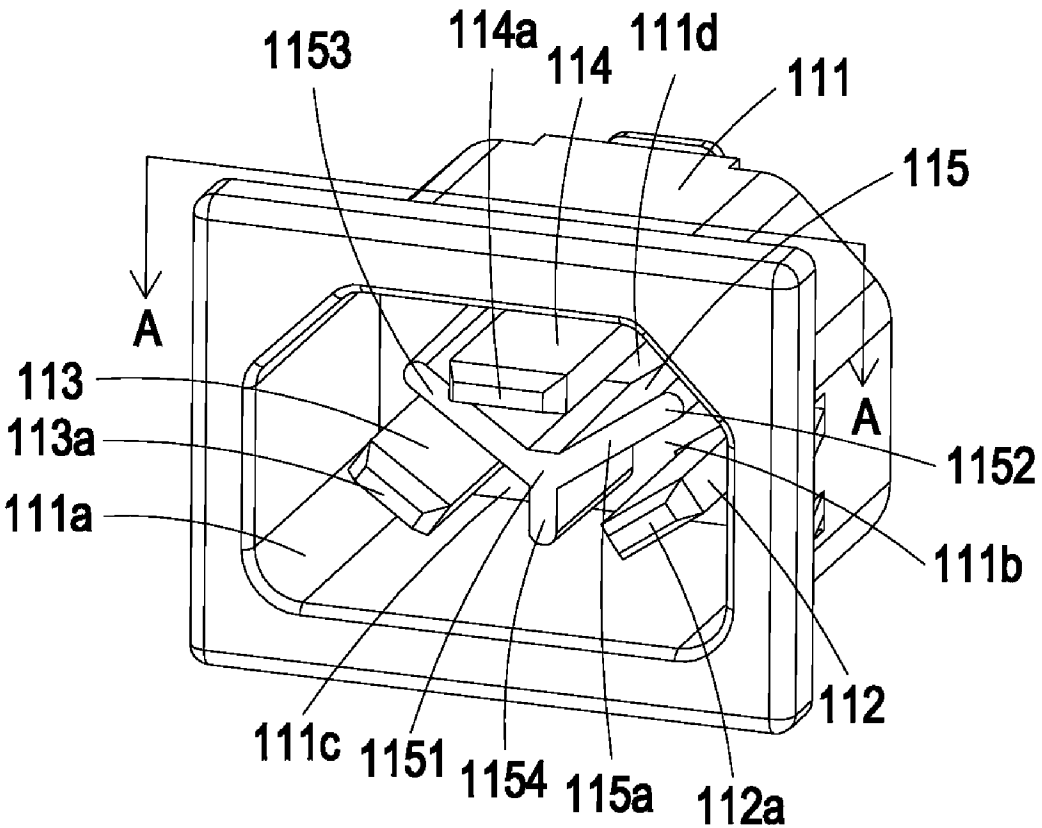
FIG. 2A is a schematic perspective view illustrating the first power connector as shown in FIG. 1.
Figure 2B:
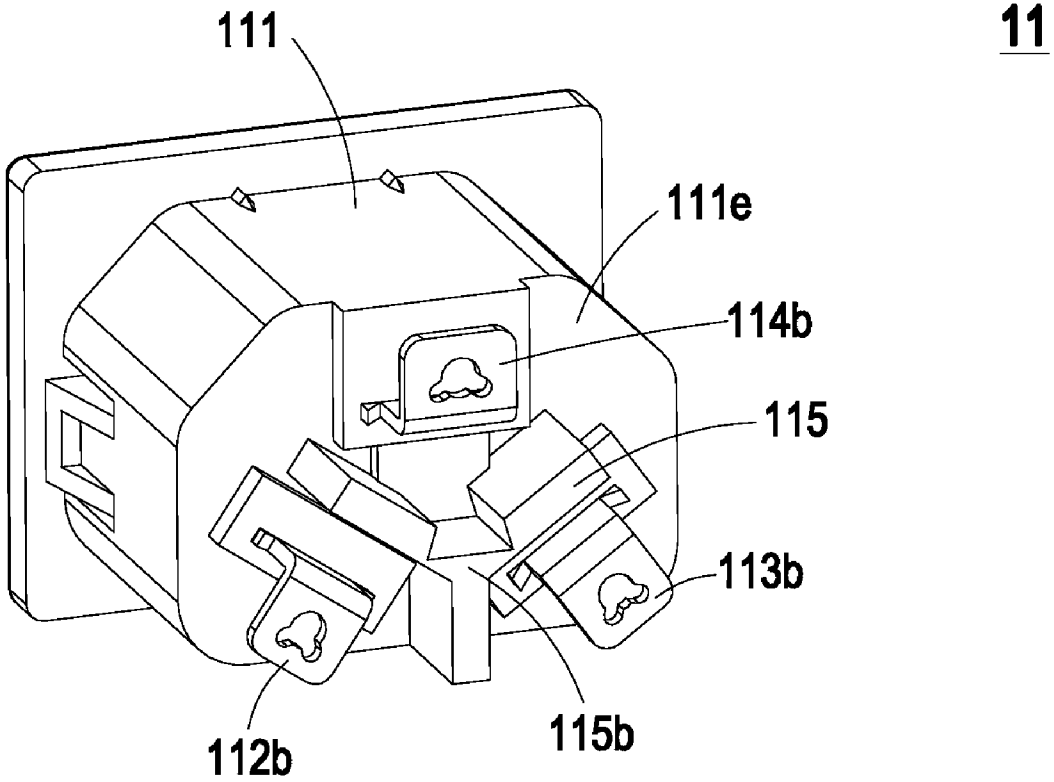
FIG. 2B is a schematic rear view illustrating the first power connector as shown in FIG. 1.
Figure 2C:
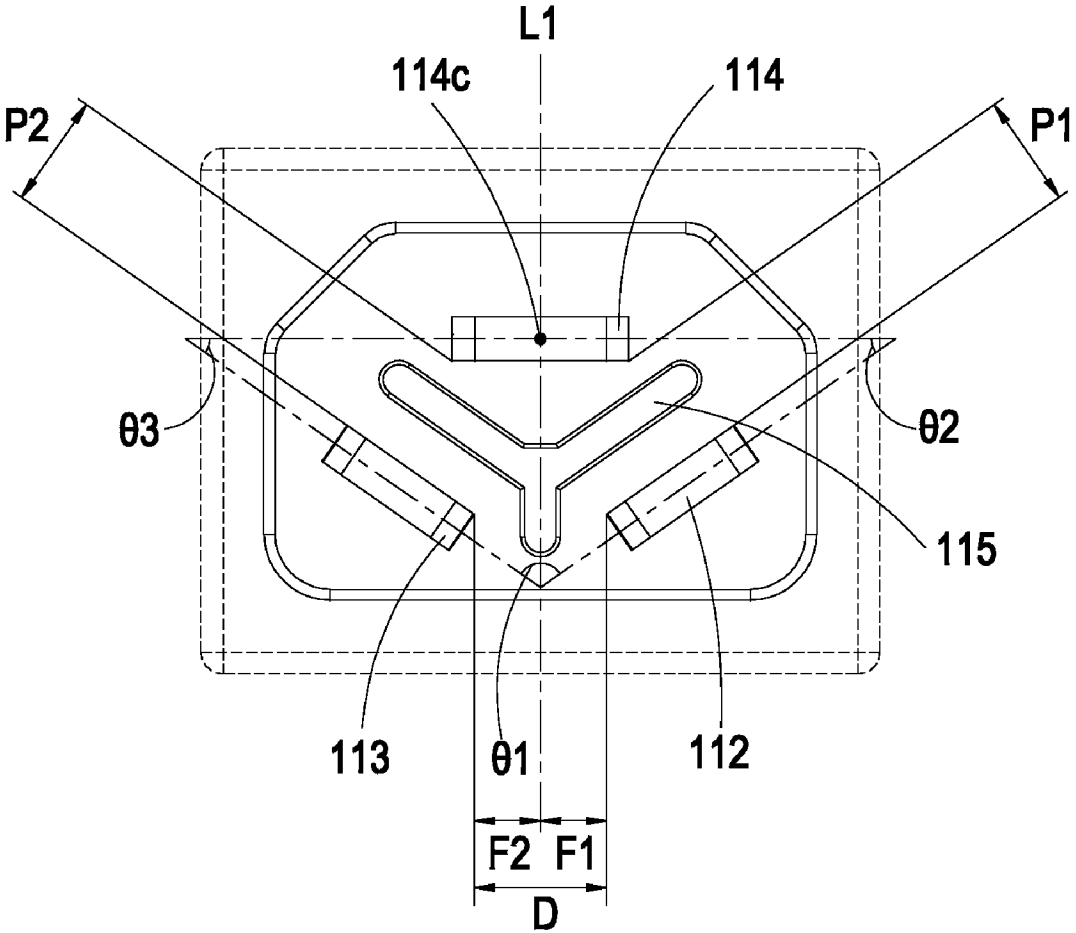
FIG. 2C is a schematic cross-sectional view illustrating the first power connector as shown in FIG. 1 and taken from the cross section AA.

FIG. 2A is a schematic perspective view illustrating the first power connector as shown in FIG. 1. FIG. 2B is a schematic rear view illustrating the first power connector as shown in FIG. 1. FIG. 2C is a schematic cross-sectional view illustrating the first power connector as shown in FIG. 1 and taken from the cross section AA. Please refer to FIGS. 2A, 2B and 2C. The first power connector 11 comprises a first main body 111 and plural conductive terminals. In this embodiment, the plural conductive terminals comprises a first conductive terminal 112, a second conductive terminal 113 and a third conductive terminal 114. The first conductive terminal 112, the second conductive terminal 113 and the third conductive terminal 114 are disposed within the first main body 111 and are not parallel with each other. The first main body 111 comprises a receptacle 111*a* and a first insulating separation member 115. The receptacle 111*a* is used for partially accommodating the second power connector 12 (not shown). The first insulating separation member 115 is disposed within the receptacle 111*a* of the first main body 111. By the first insulating separation member 115, the receptacle 111*a* is divided into plural separating regions. The plural separating regions comprise a first separating region 111*b*, a second separating region 111*c* and a third separating region 111*d*. In this embodiment, the first conductive terminal 112, the second conductive terminal 113 and the third conductive terminal 114 are partially arranged within the receptacle 111*a*. The first conductive terminal 112, the second conductive terminal 113 and the third conductive terminal 114 are arranged in the first separating region 111*b*, the second separating region 111*c* and the third separating region 111*d*, respectively. By the first insulating separation member 115, at least two of the first conductive terminal 112, the second conductive terminal 113 and the third conductive terminal 114 are isolated from each other in order to increase the creepage distance between these conductive terminals.

In this embodiment, the first conductive terminal 112 and the second conductive terminal 113 of the first power connector 11 are a positive conductive terminal and a negative conductive terminal, respectively. Alternatively, the first conductive terminal 112 and the second conductive terminal 113 of the first power connector 11 are a negative conductive terminal and a positive conductive terminal, respectively. The third conductive terminal 114 is a ground terminal. The first conductive terminal 112, the second conductive terminal 113 and the third conductive terminal 114 are rectangular metallic plates. In addition, the first conductive terminal 112, the second conductive terminal 113 and the third conductive terminal 114 are partially embedded into the first main body 111. The first free ends 112*a*, 113*a* and 114*a* of the conductive terminals 112, 113 and 114 are disposed within the receptacle 111*a*. The conductive terminals 112, 113 and 114 are extended from the bottom to the entrance of the receptacle 111*a*. The first free ends 112*a*, 113*a* and 114*a* are substantially at the same plane to define an insertion plane. The second free ends 112*b*, 113*b* and 114*b* of the conductive terminals 112, 113 and 114 are protruded out of an external surface 111*e* of the first main body 111. The second free ends 112*b*, 113*b* and 114*b* have respective connecting parts (e.g. connecting perforations). The external surface 111*e* is opposed to the entrance of the receptacle 111*a*. In this embodiment, the first insulating separation member 115 is an insulating separation plate with a first free end part 115*a* and a second free end part 115*b*. The first free end part 115*a* is extended from the bottom to the entrance of the receptacle 111*a*. In addition, the first free end part 115*a* is substantially arranged in the middle of the receptacle 111*a*. The second free end part 115*b* is protruded out of the external surface 111*e* of the first main body 111. The first insulating separation member 115 has a middle convex structure 1151 and plural extension walls (e.g. a first extension wall 1152, a second extension wall 1153 and a third extension wall 1154). The first extension wall 1152, the second extension wall 1153 and the third extension wall 1154 are radially extended from the middle convex structure 1151, thereby defining the plural separating regions. The first separating region 111*b* is defined between the first extension wall 1152 and the third extension wall 1154. The second separating region 111*c* is defined between the second extension wall 1153 and the third extension wall 1154. The third separating region 111*d* is defined between the first extension wall 1152 and the second extension wall 1153. In this embodiment, the first insulating separation member 115 is a Y-shaped insulating separation plate. In some embodiments, the first free end part 115*a* of the first insulating separation member 115 is closer to the entrance of the receptacle 111*a* than the insertion plane of the first free ends 112*a*, 113*a* and 114*a* of the conductive terminals 112, 113 and 114. In some embodiments, the insertion plane of the first free ends 112*a*, 113*a* and 114*a* of the conductive terminals 112, 113 and 114 is closer to the entrance of the receptacle 111*a* than the first free end part 115*a* of the first insulating separation member 115.

In this embodiment, the first free ends 112*a*, 113*a* and 114*a* of the conductive terminals 112, 113 and 114 have beveled edges (i.e. tapered structures). The beveled edges may reduce the tip abrasion during the two power connectors are connected with each other.

In an embodiment, as shown in FIG. 2C, the first conductive terminal 112, the second conductive terminal 113 are 2×5 mm rectangular metallic terminals, and the third conductive terminal 114 is a 2×6 mm rectangular metallic terminal. The first conductive terminal 112, the second conductive terminal 113 and the third conductive terminal 114 are not parallel with each other. As shown in FIG. 2C, in any cross section parallel with the entrance plane, a first angle θ1 between the line passing through the first conductive terminal 112 and the line passing through the second conductive terminal 113 is 100~120 degrees. In addition, a second angle θ2 between the line passing through the third conductive terminal 114 and the line passing through the first conductive terminal 112 is 30~40 degrees. In addition, a third angle θ3 between the line passing through the third conductive terminal 114 and the line passing through the second conductive terminal 113 is 30~40 degrees. That is, in the cross section parallel with the entrance plane, the first conductive terminal 112, the second conductive terminal 113 and the third conductive terminal 114 collectively define a triangle.

Please refer to FIG. 2C again. In the cross section parallel with the entrance plane, the vertical line L1 passing through the center 114*c* of the third conductive terminal 114 is a centerline axis. The first conductive terminal 112 and the second conductive terminal 113 are symmetrical with respect to the centerline axis L1. The shortest distance P1 between the first conductive terminal 112 and the third conductive terminal 114 is 5.5~6 mm. Similarly, the shortest distance P2 between the second conductive terminal 113 and the third conductive terminal 114 is 5.5~6 mm. The shortest distance F1 between the first conductive terminal 112 and the centerline axis L1 is 3.75~4 mm. Similarly, the shortest distance F2 between the second conductive terminal 113 and the centerline axis L1 is 3.75~4 mm. The shortest distance D between the first conductive terminal 112 and the second conductive terminal 113 is 7.5~8 mm.

In this embodiment, the first extension wall 1152 is arranged between the first conductive terminal 112 and the third conductive terminal 114, the second extension wall 1152 is arranged between the second conductive terminal 113 and the third conductive terminal 114, and the third extension wall 1154 is arranged between the first conductive terminal 112 and the second conductive terminal 113. Due to the extension walls 1152, 1153 and 1154 of the first insulating separation member 115, the creepage distance or the clearance distance is increased. In some embodiments, the first insulating separation member 115 has a foolproof structure for avoiding erroneous connection between the two power connectors. In addition, the foolproof structure may avoid damage of the conductive terminals. The first power connector 11 complies with the electric safe standard of high-voltage power distribution and supply systems (e.g. UL/IEC60950 electric safe standard). For example, the first power connector 11 is a power connector withstanding a specified high voltage (e.g. 220V~400V).

Figure 3A:
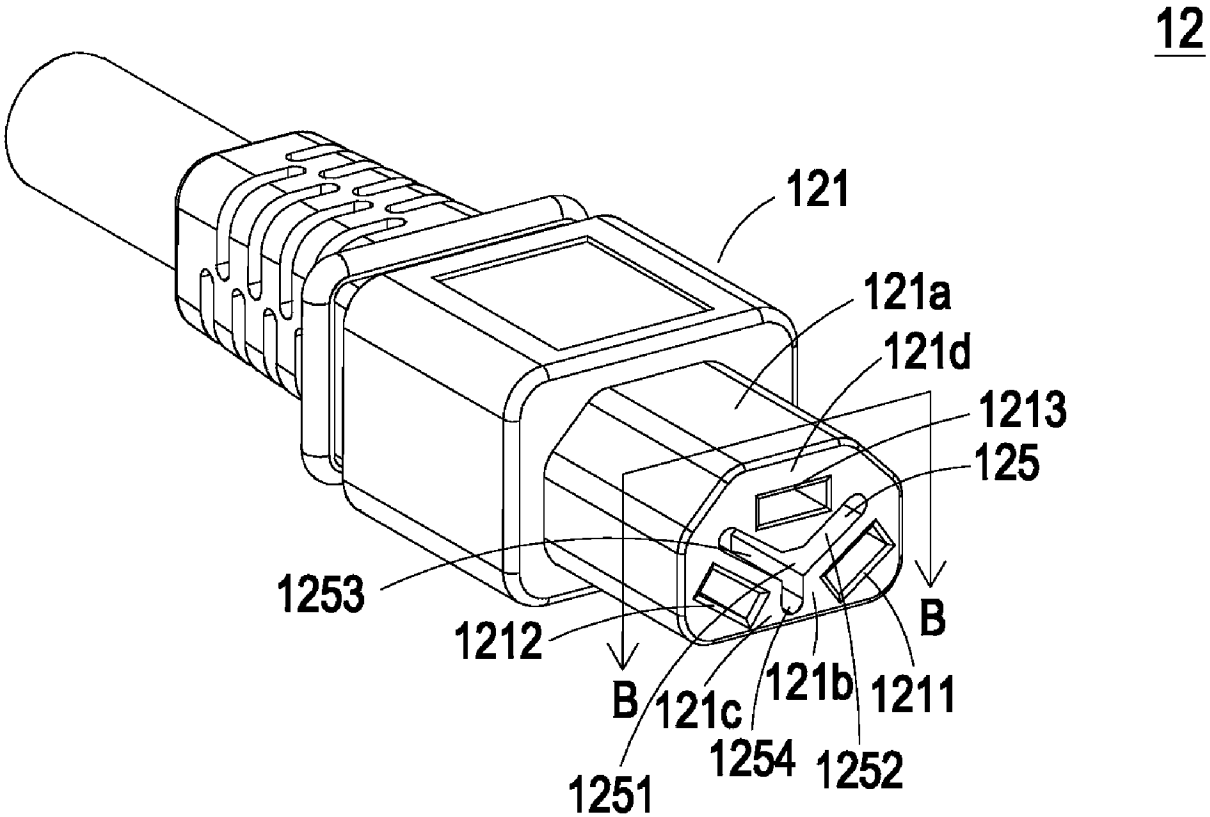
FIG. 3A is a schematic perspective view illustrating the second power connector as shown in FIG. 1.
Figure 3B:
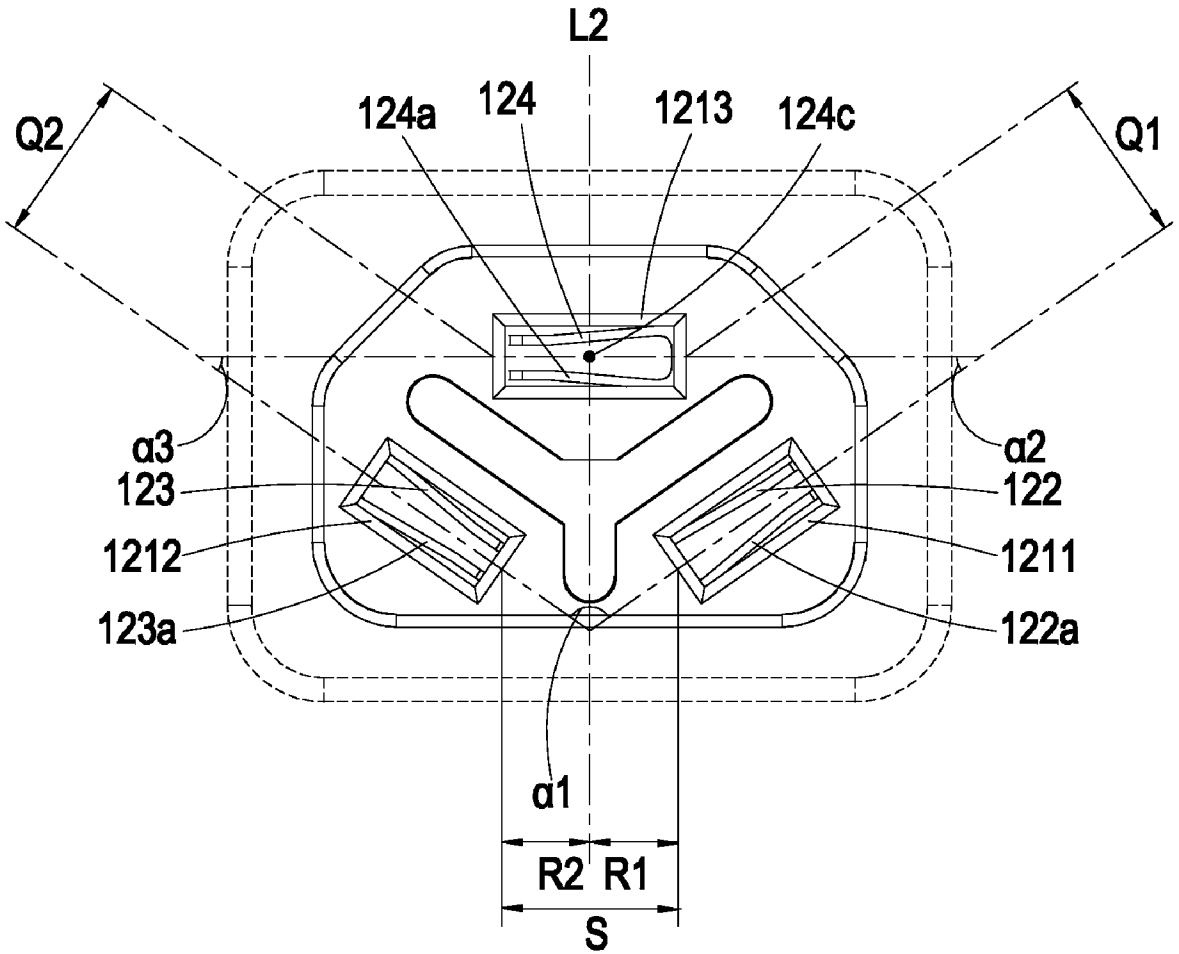
FIG. 3B is a schematic cross-sectional view illustrating the second power connector as shown in FIG. 1 and taken from the cross section BB.

FIG. 3A is a schematic perspective view illustrating the second power connector as shown in FIG. 1. FIG. 3B is a schematic cross-sectional view illustrating the second power connector as shown in FIG. 1 and taken from the cross section BB. Please refer to FIGS. 3A and 3B. The second power connector 12 comprises a second main body 121 and plural conductive terminals. In this embodiment, the plural conductive terminals comprises a first conductive terminal 122, a second conductive terminal 123 and a third conductive terminal 124. The first conductive terminal 122, the second conductive terminal 123 and the third conductive terminal 124 are disposed within the second main body 121 and are not parallel with each other. The second main body 121 comprises an inserting member 121*a* and a second insulating separation member 125. The inserting member 121*a* is substantially a bulge, which could be partially accommodated within the receptacle of the first power connector 11 (see FIG. 1). The second insulating separation member 125 is disposed within the inserting member 121*a* of the second main body 121. By the second insulating separation member 125, the inserting member 121*a* is divided into plural separating regions. The plural separating regions comprise a first separating region 121*b*, a second separating region 121*c* and a third separating region 121*d*. In this embodiment, the inserting member 121*a* of the second main body 121 further comprises a first indentation 1211, a second indentation 1212 and a third indentation 1213. The first conductive terminal 122, the second conductive terminal 123 and the third conductive terminal 124 are respectively received in the first indentation 1211, the second indentation 1212 and the third indentation 1213. In addition, the first indentation 1211, the second indentation 1212 and the third indentation 1213 are respectively arranged in the first separating region 121*b*, the second separating region 121*c* and the third separating region 121*d*. By the second insulating separation member 125, at least two of the first conductive terminal 122, the second conductive terminal 123 and the third conductive terminal 124 are isolated from each other in order to increase the creepage distance between these conductive terminals.

In this embodiment, the first conductive terminal 122 and the second conductive terminal 123 of the second power connector 12 are a positive conductive terminal and a negative conductive terminal, respectively. Alternatively, the first conductive terminal 122 and the second conductive terminal 123 of the second power connector 12 are a negative conductive terminal and a positive conductive terminal, respectively. The third conductive terminal 124 is a ground terminal. In addition, the first conductive terminal 122, the second conductive terminal 123 and the third conductive terminal 124 are partially embedded into the second main body 121. The first free ends 122*a*, 123*a* and 124*a* of the conductive terminals 122, 123 and 124 are respectively disposed within the indentations 1211, 1212 and 1213 in order to avoid carelessly getting an electric shock. In this embodiment, the second insulating separation member 125 is an insulating separation recess. The second insulating separation member 125 comprises a middle concave structure 1251, a first extension groove 1252, a second extension groove 1253 and a third extension groove 1254. These extension grooves 1252, 1253 and 1254 are radially extended from the middle concave structure 1251, thereby defining the plural separating regions of the inserting member 121*a*. The first separating region 121*b* is defined between the first extension groove 1252 and the third extension groove 1254. The second separating region 121*c* is defined between the second extension groove 1253 and the third extension groove 1254. The third separating region 121*d* is defined between the first extension groove 1252 and the second extension groove 1253. In this embodiment, the second insulating separation member 125 is a Y-shaped insulating separation recess.

Please refer to FIG. 3B again. The first conductive terminal 122, the second conductive terminal 123 and the third conductive terminal 124 are not parallel with each other. As shown in FIG. 3B, in any cross section parallel with the front surface of inserting member 121*a*, a first angle $\alpha 1$ between the line passing through the first indentation 1211 and the line passing through the second indentation 1212 is 100~120 degrees. In addition, a second angle $\alpha 2$ between the line passing through the third indentation 1213 and the line passing through the first indentation 1211 is 30~40 degrees. In addition, a third angle $\alpha 3$ between the line passing through the third indentation 1213 and the line passing through the second indentation 1212 is 30~40 degrees. That is, in this cross section, the first indentation 1211, the second indentation 1212 and the third indentation 1213 collectively define a triangle.

Please refer to FIG. 3B again. In this cross section, the vertical line L2 passing through the center 124*c* of the third conductive terminal 124 is a centerline axis. The first conductive terminal 122 and the second conductive terminal 123 are symmetrical with respect to the centerline axis L2. The shortest distance Q1 between the first indentation 1211 and the third indentation 1213 is 7~7.5 mm. Similarly, the shortest distance Q2 between the second indentation 1212 and the third indentation 1213 is 7~7.5 mm. The shortest distance R1 between the first indentation 1211 and the centerline axis L2 is 3.8~4.2 mm. Similarly, the shortest distance R2 between the second indentation 1212 and the centerline axis L2 is 3.8~4.2 mm. The shortest distance S between the first indentation 1211 and the second indentation 1212 is 7.6~8.4 mm.

In this embodiment, the first extension groove 1252 is arranged between the first conductive terminal 122 and the third conductive terminal 124, the second extension groove 1253 is arranged between the second conductive terminal 123 and the third conductive terminal 124, and the third extension groove 1254 is arranged between the first conductive terminal 122 and the second conductive terminal 123. Due to the extension grooves 1252, 1253 and 1254 of the second insulating separation member 125, the creepage distance or the clearance distance is increased. In some embodiments, the second insulating separation member 125 has a foolproof structure for avoiding erroneous connection between the two power connectors. In addition, the foolproof structure may avoid damage of the conductive terminals. The second power connector 12 complies with the electric safe standard of high-voltage power distribution and supply systems (e.g. UL/IEC60950 electric safe standard). For example, the second power connector 12 is a power connector withstanding a specified high voltage (e.g. 220V~400V).

Please refer to FIGS. 1, 2 and 3 again. For coupling the first power connector 11 with the second power connector 12, the complementary profiles of the first insulating separation member 115 (e.g. an insulating separation plate) and the second insulating separation member 125 (e.g. an insulating separation recess) may facilitate guiding engagement between the first power connector 11 and the second power connector 12. After the first power connector 11 and the second power connector 12 are coupled with each other, the conductive terminals 112, 113 and 114 of the first power connector 11 are respectively contacted with the conductive terminals 122, 123 and 124 of the second power connector 12.

Figure 4:
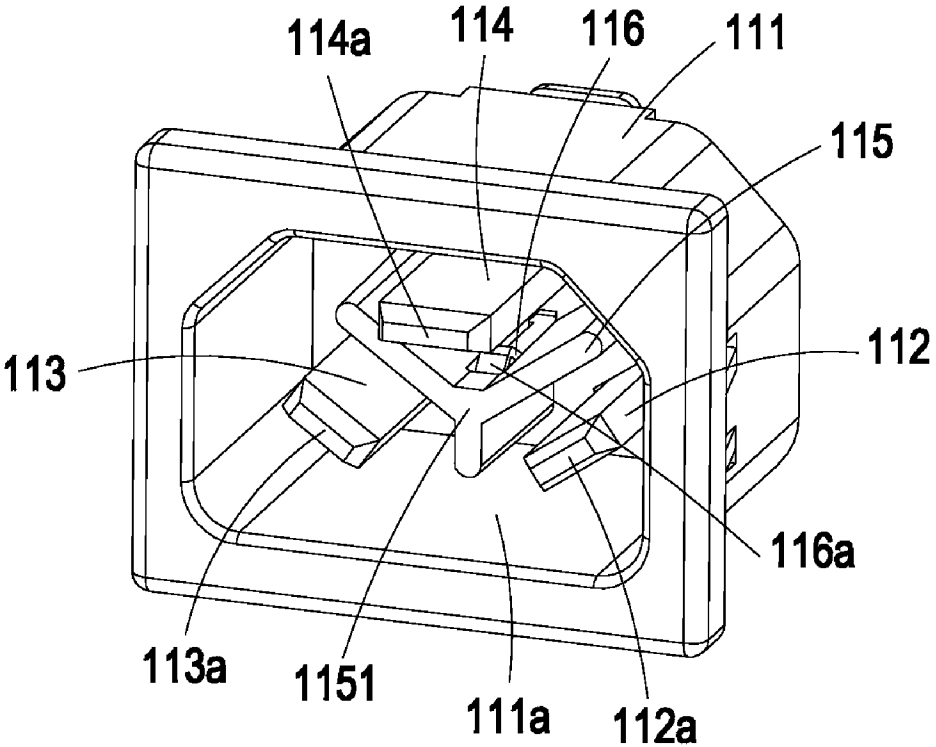
FIG. 4 is a schematic perspective view illustrating another exemplary first power connector of the present invention.
Figure 5A:
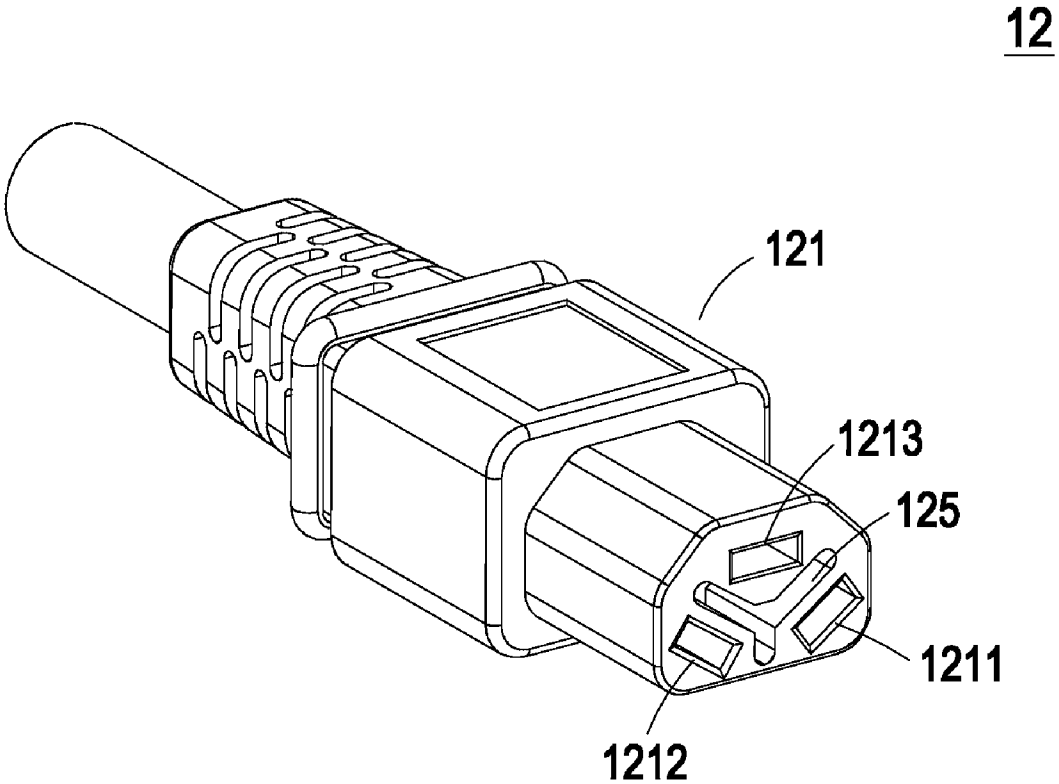
FIG. 5A is a schematic perspective view illustrating another exemplary second power connector of the present invention.
Figure 5B:
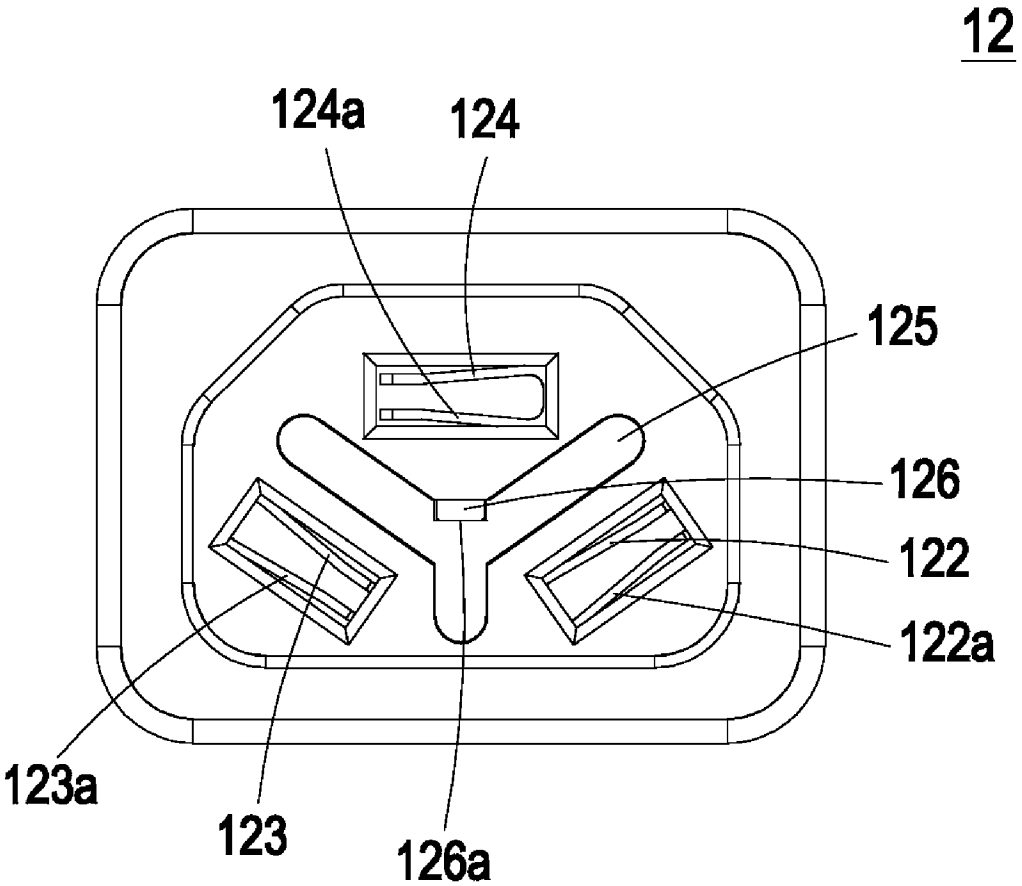
FIG. 5B is a schematic front view illustrating the second power connector as shown in FIG. 5A.

FIG. 4 is a schematic perspective view illustrating another exemplary first power connector of the present invention. FIG. 5A is a schematic perspective view illustrating another exemplary second power connector of the present invention. FIG. 5B is a schematic front view illustrating the second power connector as shown in FIG. 5A. Please refer to FIGS. 4, 5A and 5B. The first power connector 11 and the second power connector 12 further comprise a first signal-detecting terminal 116 and a second signal-detecting terminal 126, respectively. Due to the first signal-detecting terminal 116 and the second signal-detecting terminal 126, the power connectors have detecting functions. The detecting functions of the power connectors may facilitate power distribution and management of the power supply system, thereby eliminating generation of electric arc. In this embodiment, the first signal-detecting terminal 116 is disposed on the first insulating separation member 115. Corresponding to the first signal-detecting terminal 116, the second signal-detecting terminal 126 is disposed on the second insulating separation member 125. When the first power connector 11 and the second power connector 12 are coupled with each other, the first signal-detecting terminal 116 and the second signal-detecting terminal 126 are contacted with each other. In some embodiments, the first signal-detecting terminal 116 of the first power connector 11 is partially embedded in the first main body 111. The first signal-detecting terminal 116 comprises a contact part 116*a* and a connecting part (not shown). The contact part 116*a* is arranged on a sidewall of the middle convex part 1151 of the first insulating separation member 115, and extended outwardly from the sidewall. For example, the connecting part (not shown) is arranged on a rear surface 111*e* (see FIG. 2B) of the first main body 111*e*. The second signal-detecting terminal 126 of the second power connector 12 is embedded in the second main body 121. The second signal-detecting terminal 126 has a contact part 126*a*. The contact part 126*a* is arranged on an inner wall of the second insulating separation member 125 (e.g. an insulating separation recess).

In this embodiment, the free ends 112*a*, 113*a* and 114*a* of the conductive terminals 112, 113 and 114 of the first power connector 11 are closer to the entrance of the receptacle 111*a* than the contact part 116*a* of the first signal-detecting terminal 116. The distance between the free end 122*a*, 123*a* or 124*a* of the conductive terminal 122, 123 or 124 and the entrance of the indentation 1211, 1212 or 1213 is shorter than the distance between the contact part 126*a* of the second signal-detecting terminal 126 to the entrance of the second insulating separation member 125 (e.g. an insulating separation recess). In such manner, during the first power connector 11 is coupled with the second power connector 12, the first signal-detecting terminal 116 and the second signal-detecting terminal 126 are contacted with each other after the conductive terminals 112, 113 and 114 of the first power connector 11 are contacted with the conductive terminals 122, 123 and 124. In addition, during the first power connector is detached from the second power connector 12, the first signal-detecting terminal 116 and the second signal-detecting terminal 126 are disconnected from each other before the conductive terminals 112, 113 and 114 of the first power connector 11 are disconnected from the conductive terminals 122, 123 and 124. The detecting functions of the power connectors may facilitate power distribution and management of the power supply system, thereby eliminating generation of electric arc. Since the electrical connection between corresponding conductive terminals is earlier than the electrical connection between corresponding signal-detecting terminals, after the detecting signal is received, the power distribution and management of the power supply system are done. In this circumstance, the problem of generating electric arc is eliminated. On the other hand, if the first power connector 11 and the second power connector 12 are unexpectedly detached from each other, the disconnection between the corresponding signal-detecting terminals is earlier than the disconnection between the corresponding conductive terminals. The detecting signal is interrupted at the moment when the corresponding signal-detecting terminals are disconnected from each other. As such, the power distribution and supply tasks are stopped before the corresponding conductive terminals are disconnected from each other. In this circumstance, the problem of generating electric arc is eliminated, and the possibility of damaging the system load is minimized.

Figure 6:
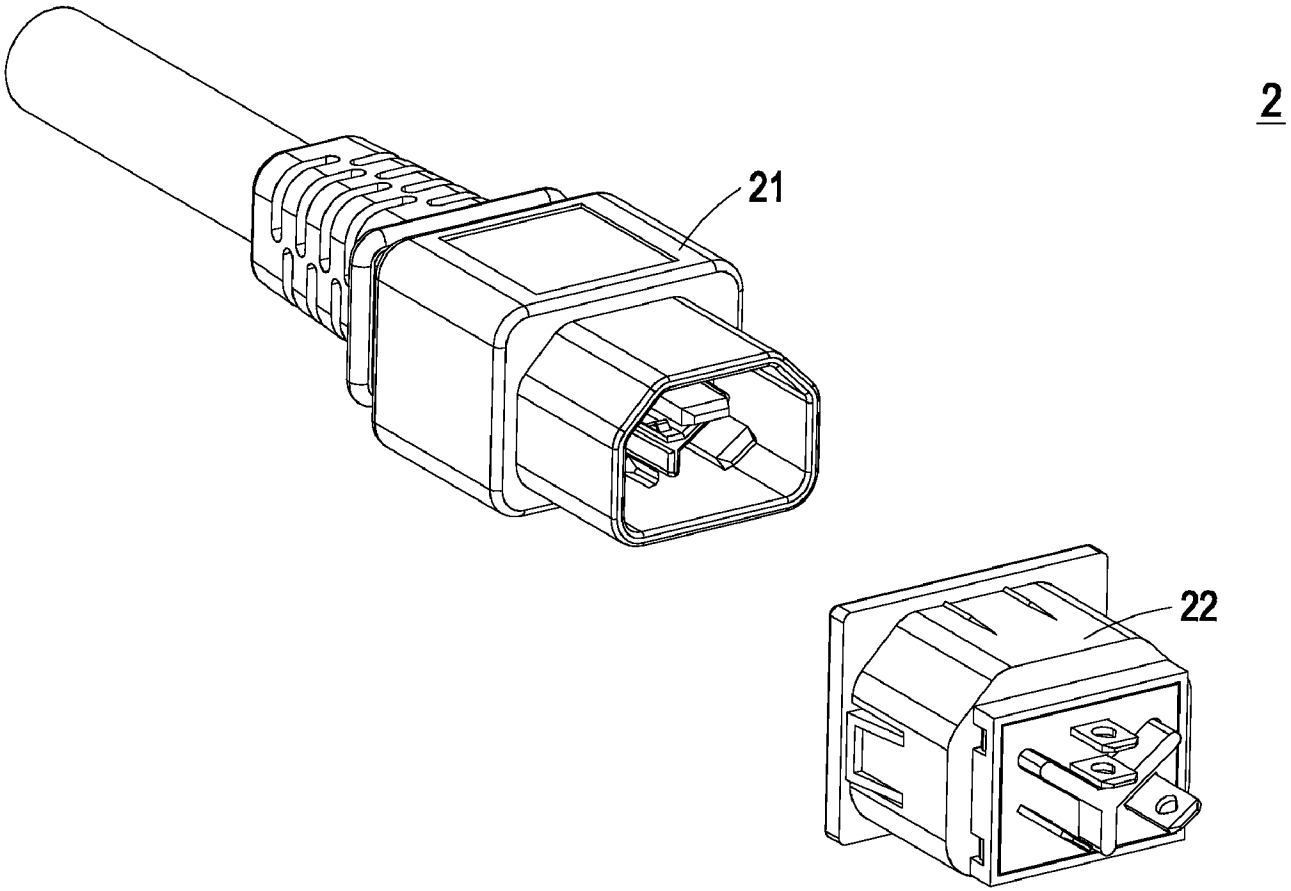
FIG. 6 is a schematic perspective view illustrating a power connector assembly according to a second embodiment of the present invention.
Figure 7:
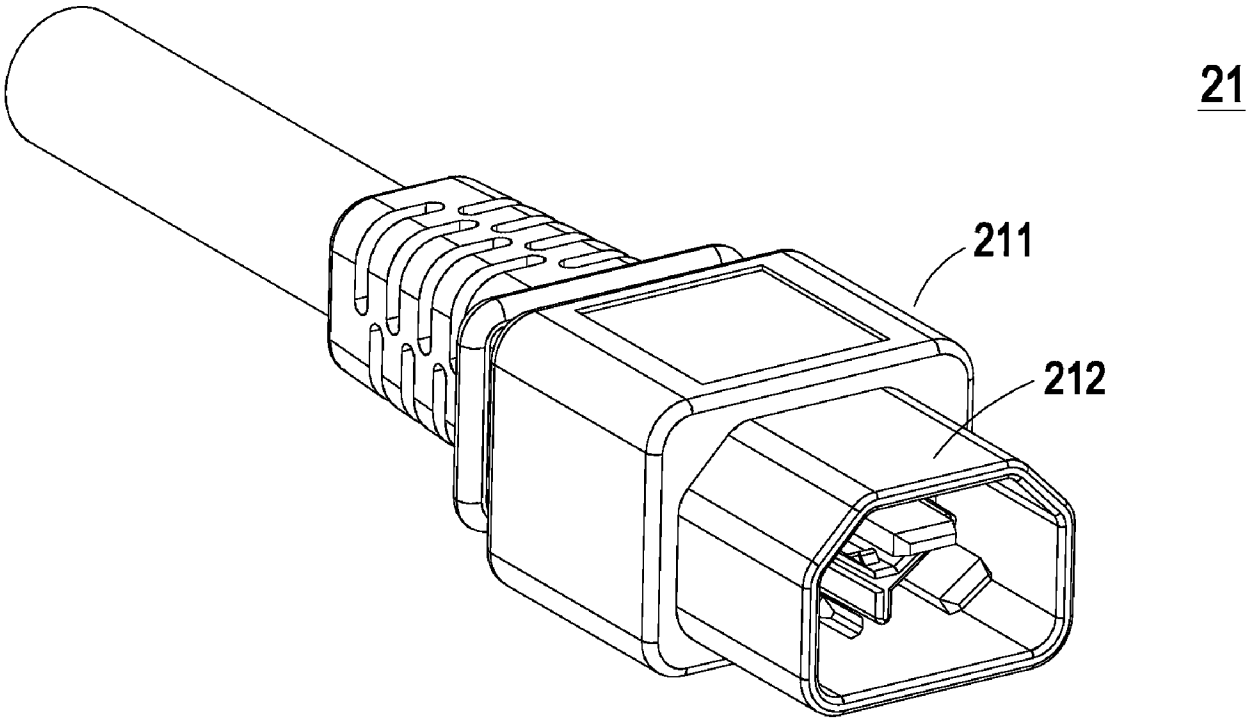
FIG. 7 is a schematic perspective view illustrating the first power connector as shown in FIG. 6.
Figure 8:
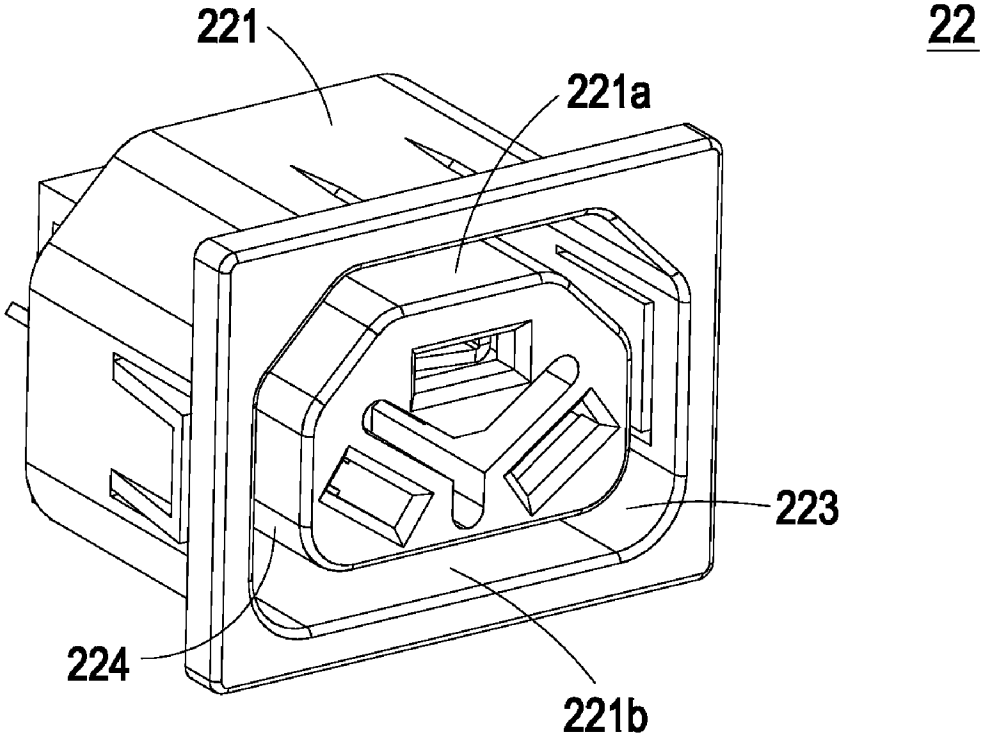
FIG. 8 is a schematic perspective view illustrating the second power connector as shown in FIG. 6.

FIG. 6 is a schematic perspective view illustrating a power connector assembly according to a second embodiment of the present invention. FIG. 7 is a schematic perspective view illustrating the first power connector as shown in FIG. 6. FIG. 8 is a schematic perspective view illustrating the second power connector as shown in FIG. 6. Please refer to FIGS. 6, 7 and 8. The power connector assembly 2 comprises a first power connector 21 and a second power connector 22. In this embodiment, the first power connector 21 is a power plug, which is for example installed on a tip portion of a power cord. The second power connector 22 is a power socket, which is for example installed on a power distribution unit (PDU). The first power connector 21 and the second power connector 22 have complementary structures. Due to the complementary structures, the first power connector 21 and the second power connector 22 are electrically with each other to produce the power connector assembly 2.

The configurations and operating principles of the first power connector 21 and the second power connector 22 are similar to those of the first power connector 11 and the second power connector 12 are shown in FIGS. 1-5 except that the first power connector 21 is a power plug and the second power connector 22 is a power socket. In addition, the first main body 211 further includes an inserting member 212, and the second main body 221 further includes a receptacle 223. The inserting member 221*a* is disposed within the receptacle 223. As such, a guiding seam 224 is defined between a sidewall 221*b* of the second main body 221 and the inserting member 221*a*. For coupling the first power connector 21 with the second power connector 22, the inserting member 212 of the first power connector 21 is accommodated within the guiding seam 224. The configurations and operating principles of other components of the first power connector 21 and the second power connector 22 are similar to those of the first power connector 11 and the second power connector 12 as shown in FIGS. 1~5, and are not redundantly described herein.

Figure 9:
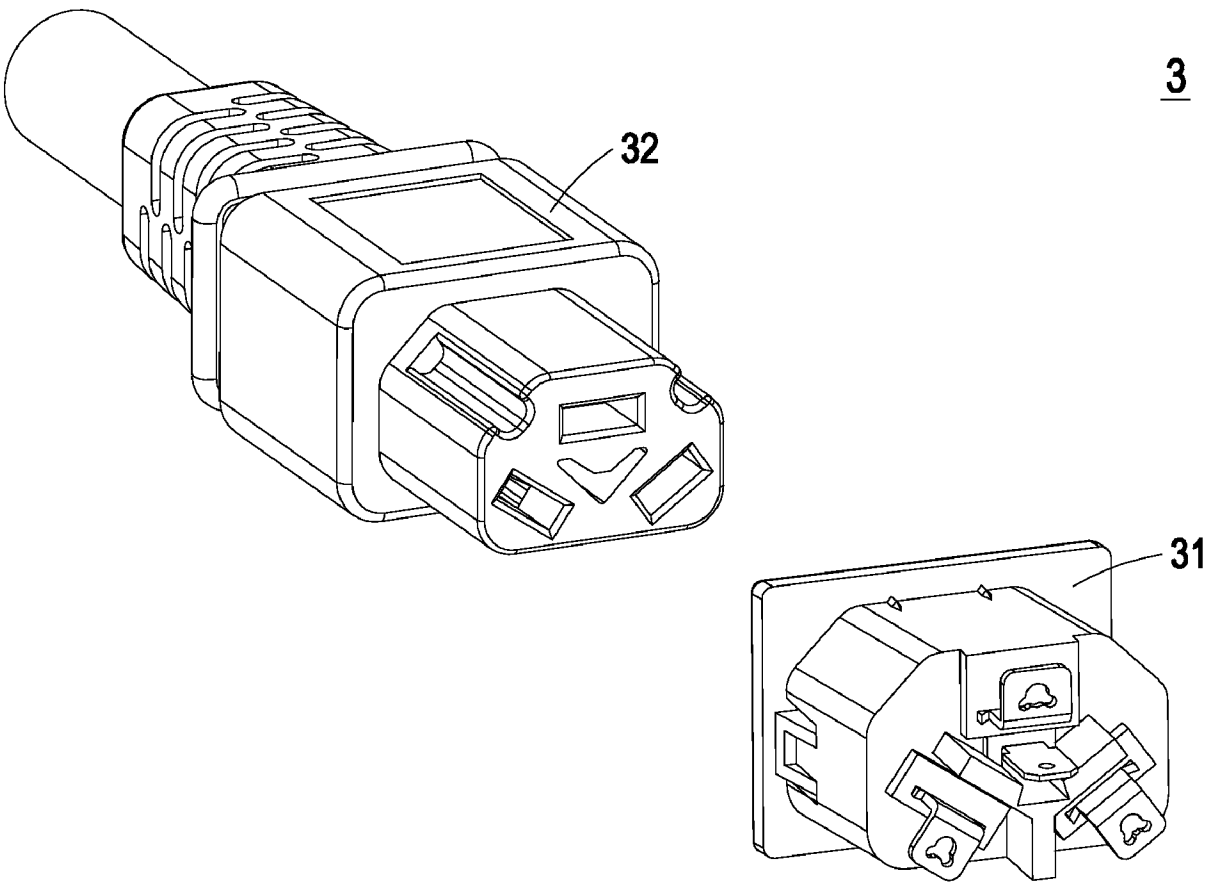
FIG. 9 is a schematic perspective view illustrating a power connector assembly according to a third embodiment of the present invention.
Figure 10:
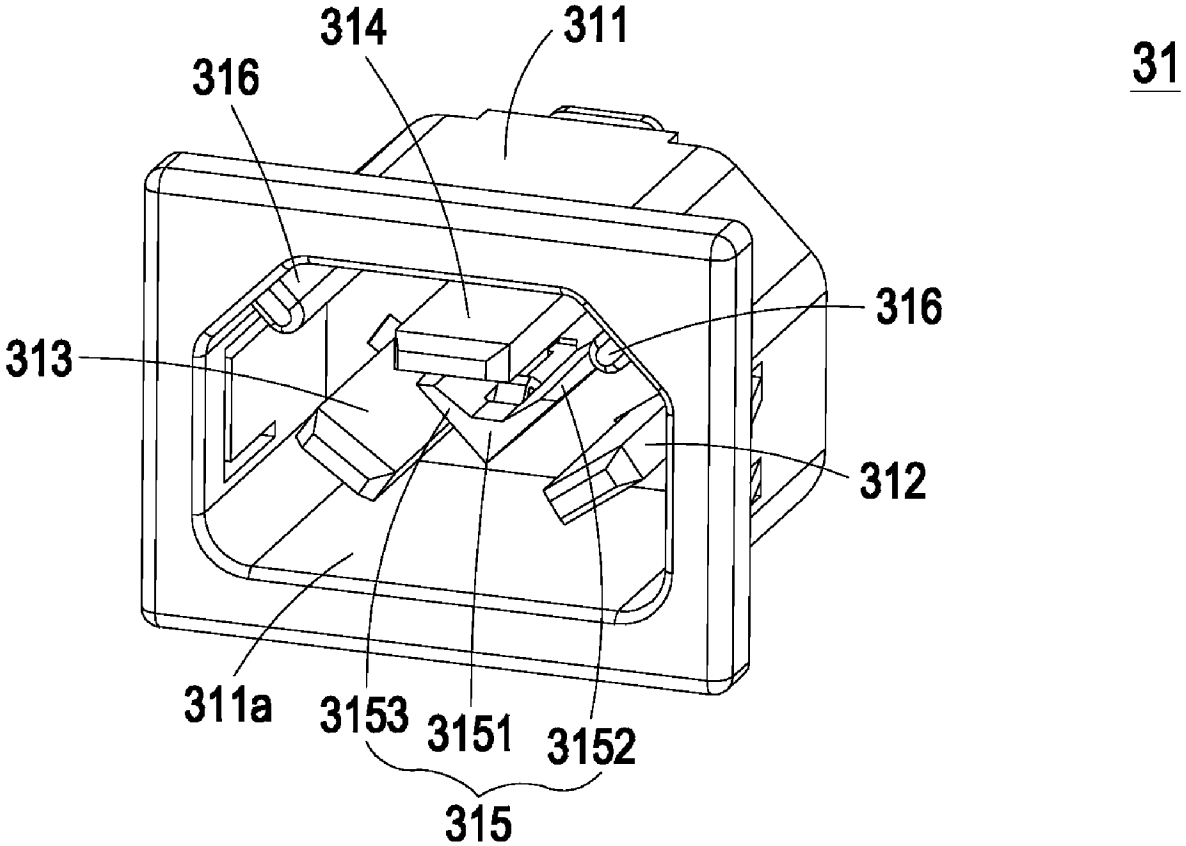
FIG. 10 is a schematic perspective view illustrating the first power connector as shown in FIG. 9.
Figure 11:
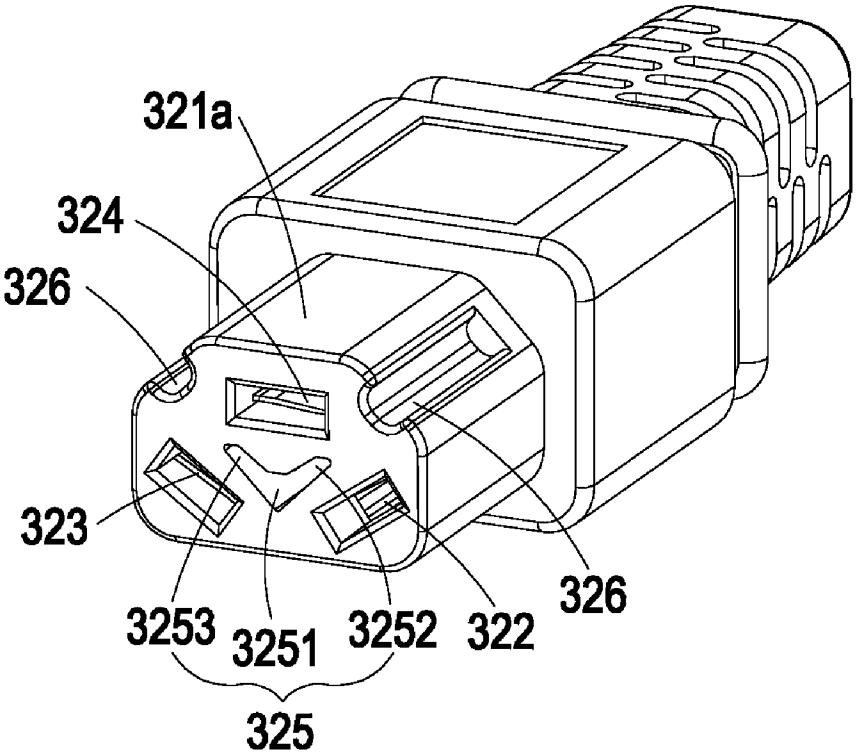
FIG. 11 is a schematic perspective view illustrating the second power connector as shown in FIG. 9.

FIG. 9 is a schematic perspective view illustrating a power connector assembly according to a third embodiment of the present invention. FIG. 10 is a schematic perspective view illustrating the first power connector as shown in FIG. 9. FIG. 11 is a schematic perspective view illustrating the second power connector as shown in FIG. 9. Please refer to FIGS. 9, 10 and 11. The power connector assembly 3 comprises a first power connector 31 and a second power connector 32. In this embodiment, the first power connector 31 is a power socket, which is for example installed on a power supply. The second power connector 32 is a power plug, which is for example installed on a tip portion of a power cord. The first power connector 31 and the second power connector 32 have complementary structures. Due to the complementary structures, the first power connector 31 and the second power connector 32 are electrically with each other to produce the power connector assembly 3.

The configurations and operating principles of the first power connector 31 and the second power connector 32 are similar to those of the first power connector 11 and the second power connector 12 are shown in FIGS. 1~5 except that the insulating separation member 315 of the first power connector 31 is a V-shaped insulating separation plate and the second insulating separation member 325 of the second power connector 22 is a V-shaped insulating separation recess. In addition, a guiding block 316 is formed on a sidewall of the receptacle 311*a* of the first main body 311. Corresponding to the guiding block 316, a guiding track 326 is formed on a sidewall of the inserting member 321*a*. When the first power connector 31 and the second power connector 32 are coupled with each other, the guiding block 316 of the first power connector 31 is received in the guiding track 326 of the second power connector 32.

In this embodiment, the insulating separation member 315 of the first power connector 31 is a V-shaped insulating separation plate. The V-shaped insulating separation plate comprises a middle convex structure 3151, a first extension wall 3152 and a second extension wall 3153. The first extension wall 3152 and the second extension wall 3153 are extended from the middle convex structure 3151. The first extension wall 3152 is arranged between the first conductive terminal 312 and the third conductive terminal 314. The second extension wall 3153 is arranged between the second conductive terminal 313 and the third conductive terminal 314. In this embodiment, the second insulating separation member 325 of the second power connector 22 is a V-shaped insulating separation recess. The V-shaped insulating separation recess comprises a middle concave structure 3251, a first extension groove 3252 and a second extension groove 3253. The first extension groove 3252 and the second extension groove 3253 are extended from the middle concave structure 3251. The first extension groove 3252 is arranged between the first conductive terminal 322 and the third conductive terminal 324. The second extension groove 3253 is arranged between the second conductive terminal 323 and the third conductive terminal 324. The configurations and operating principles of other components of the first power connector 31 and the second power connector 32 are similar to those of the first power connector 11 and the second power connector 12 as shown in FIGS. 1~5, and are not redundantly described herein. In this embodiment, the power connector assembly 3 may be applied to for example 227V power connectors.

Figure 12:
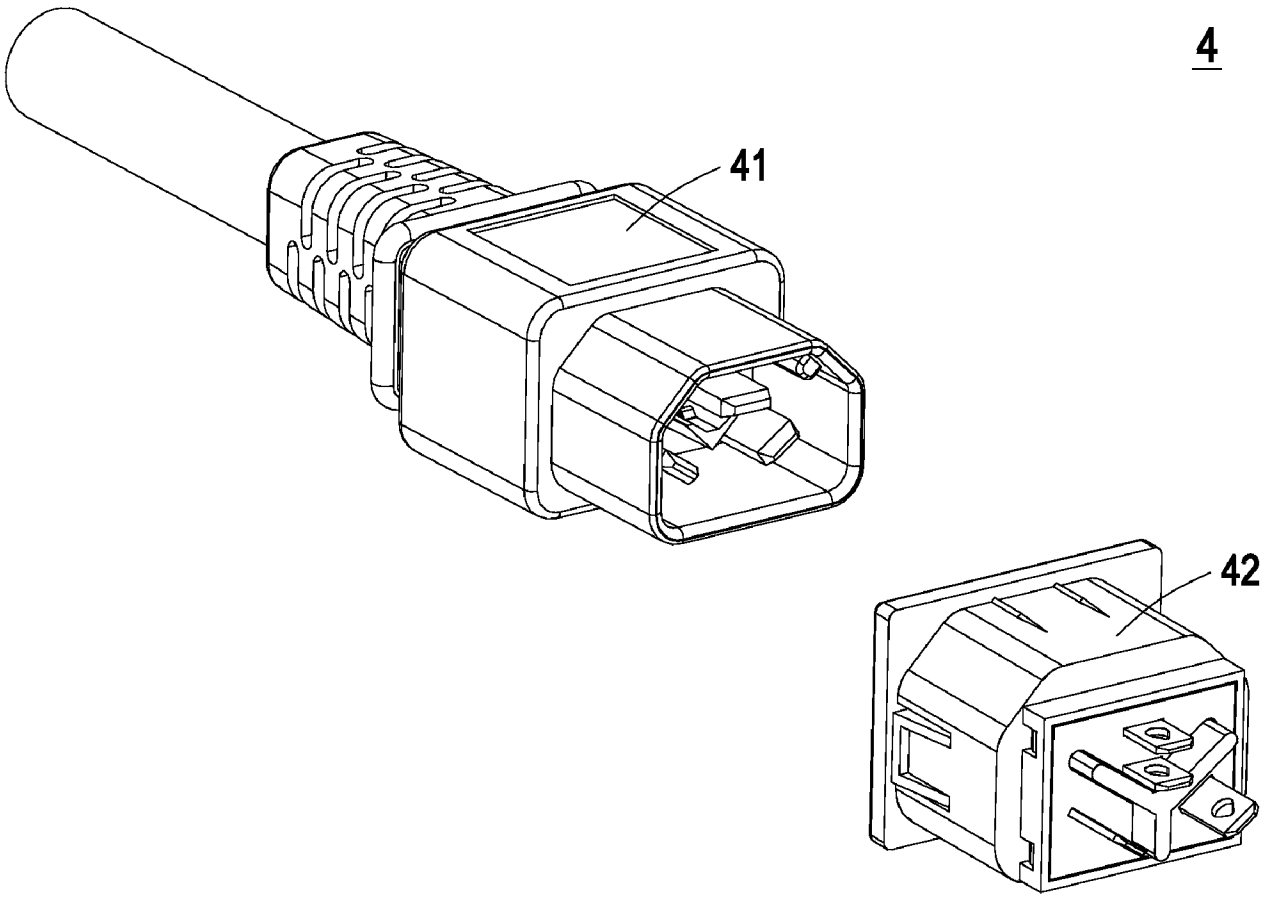
FIG. 12 is a schematic perspective view illustrating a power connector assembly according to a fourth embodiment of the present invention.
Figure 13:
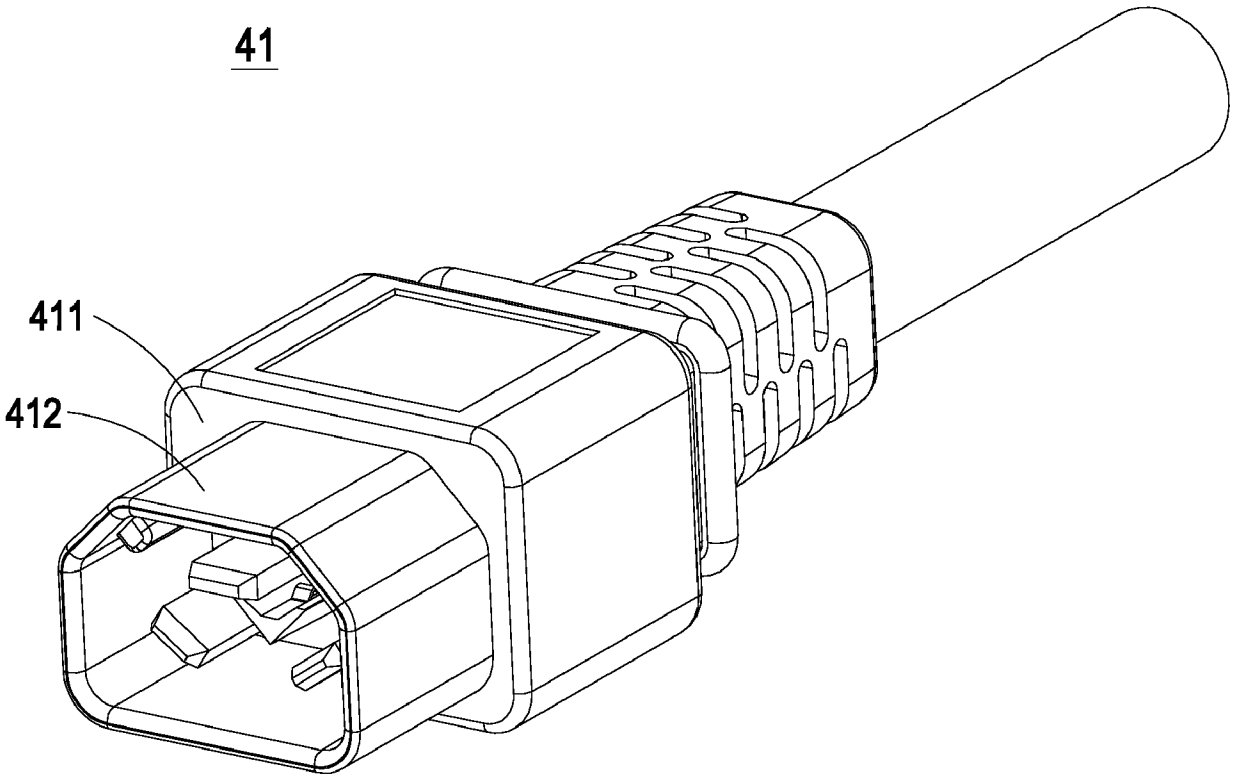
FIG. 13 is a schematic perspective view illustrating the first power connector as shown in FIG. 12.
Figure 14:
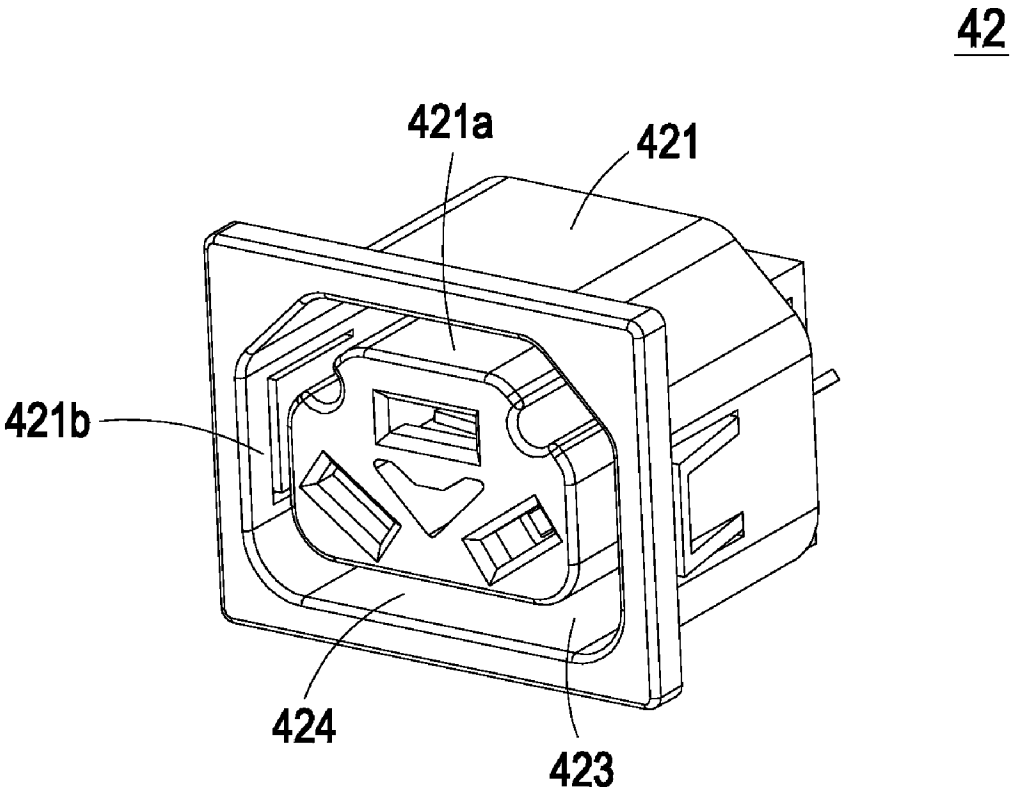
FIG. 14 is a schematic perspective view illustrating the second power connector as shown in FIG. 12.

FIG. 12 is a schematic perspective view illustrating a power connector assembly according to a fourth embodiment of the present invention. FIG. 13 is a schematic perspective view illustrating the first power connector as shown in FIG. 12. FIG. 14 is a schematic perspective view illustrating the second power connector as shown in FIG. 12. Please refer to FIGS. 12, 13 and 14. The power connector assembly 4 comprises a first power connector 41 and a second power connector 42. In this embodiment, the first power connector 41 is a power plug, which is for example installed on a tip portion of a power cord. The second power connector 42 is a power socket, which is for example installed on a power distribution unit (PDU). The first power connector 41 and the second power connector 42 have complementary structures. Due to the complementary structures, the first power connector 41 and the second power connector 42 are electrically with each other to produce the power connector assembly 4.

The configurations and operating principles of the first power connector 41 and the second power connector 42 are similar to those of the first power connector 31 and the second power connector 32 are shown in FIGS. 9~11 except that the first power connector 41 is a power plug and the second power connector 42 is a power socket. In addition, the first main body 411 further includes an inserting member 412, and the second main body 421 further includes a receptacle 423. The inserting member 421*a* is disposed within the receptacle 423. As such, a guiding seam 424 is defined between a sidewall 421*b* of the second main body 421 and the inserting member 421*a*. For coupling the first power connector 41 with the second power connector 42, the inserting member 212 of the first power connector 41 is accommodated within the guiding seam 424. The configurations and operating principles of other components of the first power connector 41 and the second power connector 42 are similar to those of the first power connector 31 and the second power connector 32 as shown in FIGS. 9~11, and are not redundantly described herein.

Figure 15:
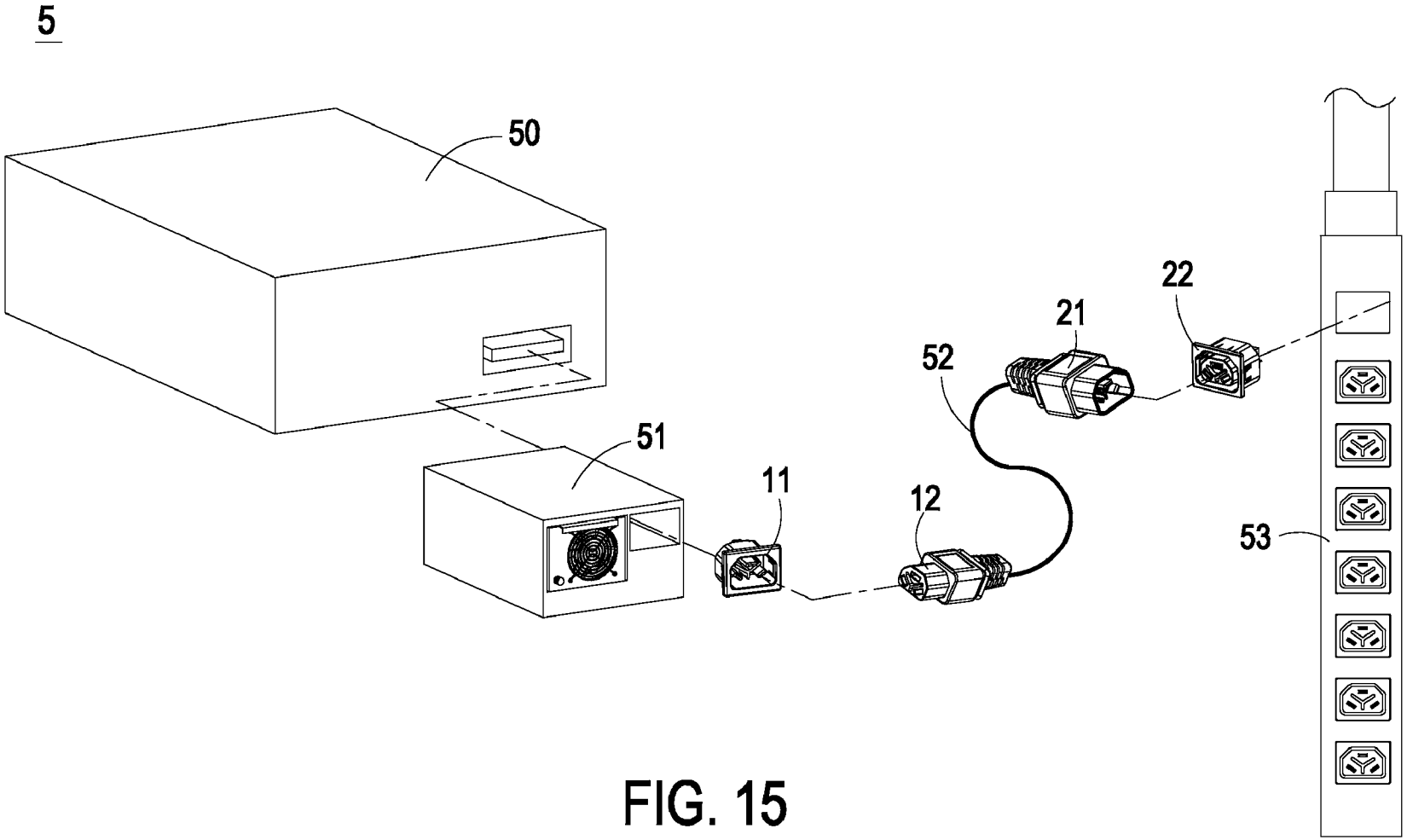
FIG. 15 is a schematic diagram illustrating the power connector assembly of the present invention applied to the power distribution and supply architecture of a data processing system.

The power connector assembly of the present invention may be applied to the power distribution and supply architecture of a data processing system (e.g. a data center). FIG. 15 is a schematic diagram illustrating the power connector assembly of the present invention applied to the power distribution and supply architecture of a data processing system. As shown in FIG. 15, the data processing system 5 comprises one or more data processing devices 50. Each data processing device 50 is electrically connected to one or more power supply apparatuses 51 and powered by the one or more power supply apparatuses 51. The power supply apparatus 51 is electrically connected to a power distribution unit 53 through a power cord 52. The power supply apparatus 51 has a first connector 11 (as shown in FIGS. 1~5). A second connector 12 is installed on a tip portion of the power cord 52. After the first connector 11 and the second connector 12 are coupled with each other, the power cord 52 is electrically connected with the power supply apparatus 51. Moreover, the other tip portion of the power cord 52 has a first power connector 21 as shown in FIGS. 6~8. The power distribution unit 53 has a second power connector 22. After the first connector 21 and the second connector 22 are coupled with each other, the power cord 52 is electrically connected with the power distribution unit 53. By means of the signal-detecting terminals of the power connector assembly, the problem of generating electric arc is eliminated and the efficacy of distributing and managing power is enhanced. Similarly, the power connector assembly 3 and the power connector assembly 4 may be applied to the power distribution and supply architecture as shown in FIG. 15.

From the above description, the power connector and the power connector assembly of the present invention are applicable to a high-voltage DC power distribution and supply system. The power connector and the power connector assembly can be produced in a simplified and cost-effective manner. Moreover, two power connectors of the power connector assembly are securely coupled with each other without damaging the conductive terminals. Since the power connector and the power connector assembly have detecting functions, the electric arc generation is avoided, electric safety is increased, and the efficacy of distributing and managing power is enhanced.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A power connector comprising:

a main body;

a first conductive terminal, a second conductive terminal and a third conductive terminal, which are disposed within said main body and arranged in a non-parallel manner;

an insulating separation member disposed within said main body, and arranged between said first conductive terminal, said second conductive terminal and said third conductive terminal for separating at least two of said first conductive terminal, said second conductive terminal and said third conductive terminal from each other; and a signal-detecting terminal disposed on a sidewall of said insulating separation member, wherein free ends of said first, second and third conductive terminals are closer to an outer periphery of said main body than a contact part of said signal-detecting terminal.

2. The power connector according to claim 1 wherein said power connector is a power socket or a power plug withstanding a specified high voltage ranged between 220V and 400V.

3. The power connector according to claim 1 wherein said main body has a receptacle, said insulating separation member is disposed within said receptacle, and said first conductive terminal, said second conductive terminal and said third conductive terminal are partially arranged within said receptacle, wherein by plural extension walls of said insulating separation member, at least two of said first conductive terminal, said second conductive terminal and said third conductive terminal are isolated from each other to increase a creepage distance therebetween.

4. The power connector according to claim 3 wherein said insulating separation member is a Y-shaped insulating separation plate comprising a middle convex structure, a first extension wall, a second extension wall and a third extension wall, wherein said first extension wall, said second extension wall and said third extension wall are radially extended from said middle convex structure, said first extension wall is arranged between said first conductive terminal and said third conductive terminal, said second extension wall is arranged between said second conductive terminal and said third conductive terminal, and said third extension wall is arranged between said first conductive terminal and said second conductive terminal.

5. The power connector according to claim 3 wherein said insulating separation member is a V-shaped insulating separation plate comprising a middle convex structure, a first extension wall and a second extension wall, wherein said first extension wall and said second extension wall are extended from said middle convex structure, said first extension wall is arranged between said first conductive terminal and said third conductive terminal, and said second extension wall is arranged between said second conductive terminal and said third conductive terminal.

6. The power connector according to claim 1 wherein free ends of said first conductive terminal, said second conductive terminal and said third conductive terminal have respective beveled edges.

7. The power connector according to claim 1 wherein said first conductive terminal is positive conductive terminal, said second conductive terminal is a negative conductive terminal, and said third conductive terminal is a ground terminal, wherein a first angle between said first conductive terminal and said second conductive terminal is 100~120 degrees, a second angle between said first conductive terminal and said third conductive terminal is 30~40 degrees, and a third angle between said second conductive terminal and said third conductive terminal is 30~40 degrees.

8. The power connector according to claim 1 wherein a vertical line passing through a center of said third conductive terminal is a centerline axis, wherein said first conductive terminal and said second conductive terminal are symmetrical with respect to said centerline axis.

9. The power connector according to claim 1 wherein said main body further comprises an inserting member, said insulating separation member is disposed within said inserting member of said main body, and said inserting member of said main body further comprises a first indentation, a second indentation and a third indentation for respectively accommodating said first conductive terminal, said second conductive terminal and said third conductive terminal, wherein by plural extension grooves of said insulating separation member, at least two of said first conductive terminal, said second conductive terminal and said third conductive terminal are isolated from each other to increase a creepage distance therebetween.

10. The power connector according to claim 9 wherein said insulating separation member is a Y-shaped insulating separation recess comprising a middle concave structure, a first extension groove, a second extension groove and a third extension groove, wherein said first extension groove, said second extension groove and said third extension groove are radially extended from said middle concave structure, said first extension groove is arranged between said first conductive terminal and said third conductive terminal, said second extension groove is arranged between said second conductive terminal and said third conductive terminal, and said third extension groove is arranged between said first conductive terminal and said second conductive terminal.

11. The power connector according to claim 9 wherein said insulating separation member is a V-shaped insulating separation recess comprising a middle concave structure, a first extension groove and a second extension groove, wherein said first extension groove and said second extension groove are extended from said middle concave structure, said first extension groove is arranged between said first conductive terminal and said third conductive terminal, and said second extension groove is arranged between said second conductive terminal and said third conductive terminal.

12. The power connector according to claim 1 wherein said main body further comprises a guiding block or a guiding track.

13. A power connector assembly comprising:

a first power connector comprising a first main body, a first conductive terminal, a second conductive terminal and a third conductive terminal, wherein said first conductive terminal, said second conductive terminal and said third conductive terminal of said first power connector are disposed within said first main body and arranged in a non-parallel manner, wherein a first insulating separation member is disposed within said first main body for separating at least two of said first conductive terminal, said second conductive terminal and said third conductive terminal of said first power connector from each other, wherein said first power connector further comprises a first signal-detecting terminal disposed on a sidewall of said first insulating separation member, wherein free ends of said first, second and third conductive terminals are closer to an outer periphery of said first main body than a contact part of said first signal-detecting terminal; and a second power connector configured to be coupled with said first power connector, and comprising a second main body, a first conductive terminal, a second conductive terminal and a third conductive terminal, wherein said first conductive terminal, said second conductive terminal and said third conductive terminal of said second power connector are disposed within said second main body and arranged in a non-parallel manner, wherein a second insulating separation member is disposed within said second main body for separating at least two of said first conductive terminal, said second conductive terminal and said third conductive terminal of said second power connector from each other, wherein said second power connector further comprises a second signal-detecting terminal disposed on an inner wall of said second insulating separation member to be contacted with said first signal-detecting terminal.

* * * * *